US011359647B2

(12) United States Patent
Makino et al.

(10) Patent No.: US 11,359,647 B2
(45) Date of Patent: Jun. 14, 2022

(54) COMPRESSION DEVICE AND SUPERCHARGER

(71) Applicant: MITSUBISHI HEAVY INDUSTRIES, LTD., Tokyo (JP)

(72) Inventors: Satoshi Makino, Nagasaki (JP); Yukihiro Iwasa, Nagasaki (JP); Yasuhiro Wada, Nagasaki (JP)

(73) Assignee: MITSUBISHI HEAVY INDUSTRIES MARINE MACHINERY & EQUIPMENT CO., LTD., Nagasaki (JP)

( * ) Notice: Subject to any disclaimer, the term of this patent is extended or adjusted under 35 U.S.C. 154(b) by 1 day.

(21) Appl. No.: 15/748,386

(22) PCT Filed: Jan. 31, 2017

(86) PCT No.: PCT/JP2017/003331
§ 371 (c)(1),
(2) Date: Jan. 29, 2018

(87) PCT Pub. No.: WO2017/169072
PCT Pub. Date: Oct. 5, 2017

(65) Prior Publication Data

US 2018/0223871 A1 Aug. 9, 2018

(30) Foreign Application Priority Data

Mar. 30, 2016 (JP) ..... JP2016-068375

(51) Int. Cl.
*F04D 29/66* (2006.01)
*F04D 29/44* (2006.01)
(Continued)

(52) U.S. Cl.
CPC ..... *F04D 29/663* (2013.01); *F01D 21/045* (2013.01); *F02B 33/40* (2013.01);
(Continued)

(58) Field of Classification Search
None
See application file for complete search history.

(56) References Cited

U.S. PATENT DOCUMENTS 4,667,769 A * 5/1987 Appel ..... F02C 7/045 181/229
8,096,127 B2 * 1/2012 Ono ..... F01D 25/16 415/119
2005/0126382 A1 6/2005 Koshimura et al.

FOREIGN PATENT DOCUMENTS

EP 3067569 A1 * 9/2016 ..... F04D 29/162
EP 3 128 184 B1 9/2018
(Continued)

OTHER PUBLICATIONS

Fukuzawa, K., JP 11-294276 (machine translation), published Oct. 26, 1999, (Year: 1999).*
(Continued)

*Primary Examiner* — Richard A Edgar
*Assistant Examiner* — Jason G Davis
(74) *Attorney, Agent, or Firm* — WHDA, LLP

(57) ABSTRACT

A compression device includes a centrifugal compressor and a silencer. The centrifugal compressor includes a compressor assembly bolt fastening an inlet side of an inlet guide to a scroll casing. The silencer includes: a first side wall extending in a direction intersecting with a rotational axis of an impeller; an annular second side wall provided between the first side wall and the centrifugal compressor and surrounding the rotational axis; at least one silencer element provided in an ambient-air introduction space formed between the first side wall and the second side wall for guiding an ambient air to the inlet guide; and a silencer assembly bolt extending from the first side wall to the scroll
(Continued)

casing in a direction along the rotational axis of the impeller and fastening the first side wall, the second side wall, and the scroll casing.

9 Claims, 4 Drawing Sheets

(51) Int. Cl.

| | |
|---|---|
| ***F04D 29/42*** | (2006.01) |
| ***F04D 29/62*** | (2006.01) |
| ***F02M 35/12*** | (2006.01) |
| ***F04D 17/10*** | (2006.01) |
| ***F02B 39/00*** | (2006.01) |
| ***F01D 21/04*** | (2006.01) |
| ***F02B 33/40*** | (2006.01) |
| *F02B 37/00* | (2006.01) |

(52) U.S. Cl.
CPC ..... *F02B 39/00* (2013.01); *F02M 35/1288* (2013.01); *F04D 29/4213* (2013.01); *F04D 29/4226* (2013.01); *F04D 29/44* (2013.01); *F04D 29/441* (2013.01); *F04D 29/624* (2013.01); *F04D 29/66* (2013.01); *F02B 37/00* (2013.01); *F04D 17/10* (2013.01)

(56) References Cited

FOREIGN PATENT DOCUMENTS

| | | | | | |
|---|---|---|---|---|---|
| GB | 2414769 | A | | 12/2005 | |
| JP | 48-7681 | Y1 | | 2/1973 | |
| JP | 11294276 | A | * | 10/1999 | |
| JP | 2001132465 | A | | 5/2001 | |
| JP | 2003-519329 | A | | 6/2003 | |
| JP | 2005-171967 | A | | 6/2005 | |
| JP | 2005-344713 | A | | 12/2005 | |
| WO | 2001050000 | A1 | | 7/2001 | |
| WO | 2015098175 | A1 | | 7/2015 | |
| WO | 2015/151653 | A1 | | 10/2015 | |
| WO | WO-2015151844 | A1 | * | 10/2015 | ..... F04D 29/162 |

OTHER PUBLICATIONS

International Search Report dated Apr. 18, 2017, issued in counterpart application No. PCT/JP2017/003331. (2 pages).
Decision to Grant a Patent dated Oct. 6, 2017, Issued in counterpart Japanese Patent Application No. 2016-068375, w/English translation (6 pages).
Office Action dated Feb. 12, 2018, issued in counterpart Korean Application No. 10-2018-7002165, with English translation (9 pages).
Notification of Transmittal of Translation of the International Preliminary Report on Patentability (Form PCT/IB/326) issued in counterpart International Appication No. PCT/JP2017/003331 dated Oct. 11, 2018 with Forms PCT/IB/373, PCT/IB/338 and PCT/ISA/237. (13 pages).
Extended (Supplementary) European Search Report dated Aug. 20, 2018, issued in counterpart application No. 17773621.2. (8 pages).
Office Action dated Mar. 25, 2019, issued in counterpart EP application No. 17773621.2. (8 pages).

* cited by examiner

COMPRESSION DEVICE AND SUPERCHARGER

TECHNICAL FIELD

The present invention relates to a compression device and a supercharger.

BACKGROUND ART

A centrifugal compressor is known as a compressor of a supercharger for compressing a fluid to be supplied to an internal combustion engine used in ships or the like. FIG. 4 is a schematic view illustrating a conventional configuration of a supercharger equipped with a centrifugal compressor. As shown in FIG. 4, a centrifugal compressor 006 includes an impeller 010 for compressing a fluid, an inlet guide 012, housing the impeller, for guiding the fluid, and a scroll casing 016 forming a scroll chamber 014 for guiding the fluid having passed through the inlet guide to outside.

Operation of the supercharger increases the impeller temperature of the compressor and decreases the creep lifetime of the impeller. If the impeller is rotated at high speed in this state up to a predetermined rotational speed (operation period), the impeller may break apart by centrifugal force or the like.

If the impeller breaks apart in the centrifugal compressor, an impeller fragment may fly apart outwardly in the radial direction of the impeller, and hit the inlet guide. The impeller fragment that hits and thereby breaks the inlet guide can fly to outside of the inlet guide.

Patent Document 1 discloses a centrifugal compressor that aims to contain an impeller fragment caused by breakage of the impeller inside an inlet guide (inner housing insert piece). The centrifugal compressor disclosed in Patent Document 1 is characterized in that a scroll casing (outer spiral housing) and/or the inlet guide is formed from a material whose elongation at break amounts to at least 5% in order to contain an impeller fragment inside the inlet guide.

CITATION LIST

Patent Literature

Patent Document 1: JP2005-344713A

SUMMARY

Problems to be Solved

Besides, as shown in FIG. 4, some supercharger includes a silencer 008 attached to a fluid inlet side of the centrifugal compressor such that the centrifugal compressor 006 can reduce generated noise.

In the compression device 004 including the centrifugal compressor and the silencer as shown in FIG. 4, the centrifugal compressor and the silencer are conventionally connected by fastening a flange 008*a* provided at the silencer, a flange 012*a* provided at the inlet guide 012, and a flange 016 provided at the scroll casing 016 with a silencer attachment bolt 031.

In this compression device, if the impeller 10 of the centrifugal compressor breaks apart, the silencer attachment bolt may break, resulting in detachment of the silencer from the centrifugal compressor in some case. The detachment of the silencer from the centrifugal compressor can cause an impeller fragment to fly from an inlet side of the inlet guide to outside.

In view of this, the present inventors have keenly studied a mechanism by which the silencer attachment bolt breaks and consequently found the following mechanism.

When the impeller of the centrifugal compressor breaks apart in the above compression device, a fluid is hard to be forced into the scroll chamber by the impeller, and rather flows back from the scroll chamber to the silencer through the inlet guide, as shown by the white arrows in FIG. 4. This backflow fluid applies force to the silencer in a direction d1 away from the inlet guide and then applies tensile stress to the silencer attachment bolt. This tensile stress causes the silencer attachment bolt to break.

In this regard, the supercharger disclosed in Patent Document 1 does not include a silencer attached to the centrifugal compressor from the beginning. This supercharger is thus not based on the premise that a technical problem of breakage of the silencer attachment bolt occurs due to breakage of the impeller.

The present invention was made in view of the above problem, and an object is to provide a compression device that reduces breakage of a bolt fastening a silencer to a centrifugal compressor and enables the silencer and the centrifugal compressor to be stably connected, and a supercharger having the same.

Solution to the Problems (1) A compression device according to at least one embodiment of the present invention comprises a centrifugal compressor and a silencer, the centrifugal compressor comprising: an impeller for compressing a fluid; an inlet guide, housing the impeller, for guiding the fluid; a scroll casing forming a scroll chamber for guiding the fluid which has passed through the inlet guide to outside; and a compressor assembly bolt fastening an inlet side of the inlet guide to the scroll casing, the silencer comprising a silencer assembly bolt penetrating through the silencer in a direction along a rotational axis of the impeller and fastening the silencer to the scroll casing.

When the impeller of the centrifugal compressor breaks apart in the compression device equipped with the centrifugal compressor and the silencer, a fluid is hard to be forced into the scroll chamber by the impeller, and rather flows back from the scroll chamber to the silencer through the inlet guide. This backflow air applies force to the silencer in a direction away from the inlet guide.

In this regard, with the compression device described in the above (1), the silencer assembly bolt for assembling the silencer extends to the scroll casing while penetrating through the silencer in a direction along the rotational axis of the impeller, and thereby also fastens the scroll casing. Thus, the bolt (silencer assembly bolt) fastening the silencer to the centrifugal compressor can be significantly longer than the bolt (silencer attachment bolt) fastening the silencer to the centrifugal compressor in the conventional configuration explained with FIG. 4.

Consequently, the bolt (silencer assembly bolt) fastening the silencer to the centrifugal compressor in the compression device described in the above (1) can have a larger elongation amount that allows the bolt to elongate without breakage when tensile load is applied in a length direction than an elongation amount of the bolt (silencer attachment bolt) fastening the silencer to the centrifugal compressor in the conventional configuration explained with FIG. 4 that allows the bolt to elongate without breakage when tensile load is applied in a length direction.

In this way, even if tensile stress caused by fluid backflow due to breakage of the impeller is applied to the bolt fastening the silencer to the centrifugal compressor, it is possible to effectively reduce breakage of the bolt. Therefore, it is possible to reduce breakage of the bolt fastening the silencer to the centrifugal compressor and enable the silencer and the centrifugal compressor to be stably connected.

Additionally, in the compression device described in the above (1), the silencer is fastened to the centrifugal compressor with the silencer assembly bolt which is different from the compressor assembly bolt fastening the inlet side of the inlet guide to the scroll casing. Thus, even if the impeller breaks apart and an impeller fragment hits the inlet guide, a shock of hitting does not propagate directly from the inlet guide to the silencer assembly bolt, but propagates from the inlet guide to the silencer assembly bolt via the scroll casing. This fact also supports that breakage of the bolt fastening the silencer to the centrifugal compressor can be effectively reduced, compared with the conventional configuration.

Additionally, since the silencer assembly bolt extends to the scroll casing while penetrating through the silencer in the direction along the rotational axis of the impeller and thereby also fastens the scroll casing, the overall rigidity of the compression device can be improved.

(2) In some embodiments, in the compression device described in the above (1), the silencer comprises: a first side wall extending in a direction intersecting with the rotational axis of the impeller; and an annular second side wall provided between the first side wall and the centrifugal compressor and surrounding the rotational axis, wherein an ambient-air introduction space for guiding an ambient air to the inlet guide is formed between the first side wall and the second side wall, and the silencer assembly bolt extends from the first side wall to the scroll casing in a direction along the rotational axis of the impeller and fastens the first side wall, the second side wall, and the scroll casing.

With the compression device described in the above (2), the silencer assembly bolt, which fastens the first side wall and the second side wall, extends from the first side wall to the scroll casing in the direction along the rotational axis of the impeller, and thereby also fastens the scroll casing. Thus, the bolt (silencer assembly bolt) fastening the silencer to the centrifugal compressor can be significantly longer than the bolt (silencer attachment bolt) fastening the silencer to the centrifugal compressor in the conventional configuration explained with FIG. 4.

Therefore, it is possible to reduce breakage of the bolt fastening the silencer to the centrifugal compressor and enable the silencer and the centrifugal compressor to be stably connected, for the same reason as the above (1).

Additionally, since the silencer assembly bolt extends from the first side wall to the scroll casing in the direction along the rotational axis of the impeller and fastens the first side wall, the second side wall, and the scroll casing, the overall rigidity of the compression device can be improved.

(3) In some embodiments, in the compression device described in the above (2), the silencer further comprises at least one silencer element provided in the ambient-air introduction space, and the silencer element is supported, in the ambient-air introduction space, by the silencer assembly bolt.

With the compression device described in the above (3), the first side wall, the second side wall, and the scroll casing can be fastened by means of the silencer assembly bolt for supporting the silencer element in the ambient-air introduction space. Thus, the silencer and the centrifugal compressor can be stably connected with a simple configuration.

(4) In some embodiments, in the compression device described in the above (3), the at least one silencer element comprises a plurality of silencer elements arranged along the rotational axis, wherein each of the plurality of silencer elements is an annular element provided around the rotational axis and has an insert hole into which the silencer assembly bolt is inserted, and the silencer element is supported, in the ambient-air introduction space, by the silencer assembly bolt inserted into the insert hole.

With the compression device described in the above (4), the first side wall, the second side wall, and the scroll casing can be fastened by means of the silencer assembly bolt for supporting the plurality of annular silencer elements arranged along the rotational axis of the impeller in the ambient-air introduction space. Thus, the silencer and the centrifugal compressor can be stably connected with a simple configuration.

(5) In some embodiments, in the compression device described in the above (1), the scroll casing comprises a scroll chamber-forming portion forming the scroll chamber, an annular first projection projecting from the scroll chamber-forming portion toward the silencer, and an annular second projection projecting from the scroll chamber-forming portion toward the silencer, the second projection being disposed more outwardly than the first projection in a radial direction of the impeller, wherein the compressor assembly bolt fastens the inlet side of the inlet guide and the first projection, and the silencer assembly bolt fastens the silencer and the second projection.

With the compression device described in the above (5), the second projection fastened to the silencer is disposed more outwardly than the first projection fastened to the inlet side of the inlet guide in the radial direction of the impeller. Thus, it is possible to reduce a risk that an impeller fragment penetrates the inlet guide or the first projection and reaches the second projection or the vicinity thereof when the impeller breaks apart. In this way, it is possible to reduce breakage of the second projection and to enable the silencer and the centrifugal compressor to be stably connected.

(6) In some embodiments, in the compression device described in the above (5), the second projection projects further than the first projection toward the silencer and abuts on the silencer, and a gap is provided between the inlet guide and the silencer so that a space formed between the first projection and the second projection communicates with a space inside the inlet guide.

When the impeller breaks apart, a fluid that flows back from the scroll chamber to the silencer has a higher pressure than atmospheric pressure. In this regard, the compression device described in the above (6) allows, when a fluid flows back from the scroll chamber to the silencer, the annular space between the first projection and the second projection to function as a buffer space for controlling an increase of pressure in the ambient-air introduction space inside the silencer.

Thus, it is possible to reduce force which is caused by the backflow fluid and applied to the silencer in the direction away from the inlet guide. This makes it possible to reduce tensile stress applied to the silencer assembly bolt and reduce breakage of the silencer assembly bolt. Consequently, the silencer and the centrifugal compressor can be stably connected.

(7) A supercharger according to at least one embodiment of the present invention comprises the compression device described in any one of the above (1) to (6) and a turbine configured to rotate with the centrifugal compressor of the compression device.

The supercharger described in the above (7) includes the compression device described in any one of the above (1) to (6), which makes it possible to reduce breakage of the bolt fastening the silencer to the centrifugal compressor and enable the silencer and the centrifugal compressor to be stably connected.

Advantageous Effects

According to at least one embodiment of the present invention, there is provided a compression device that reduces breakage of a bolt fastening a silencer to a centrifugal compressor and enables the silencer and the centrifugal compressor to be stably connected, and a supercharger having the same.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
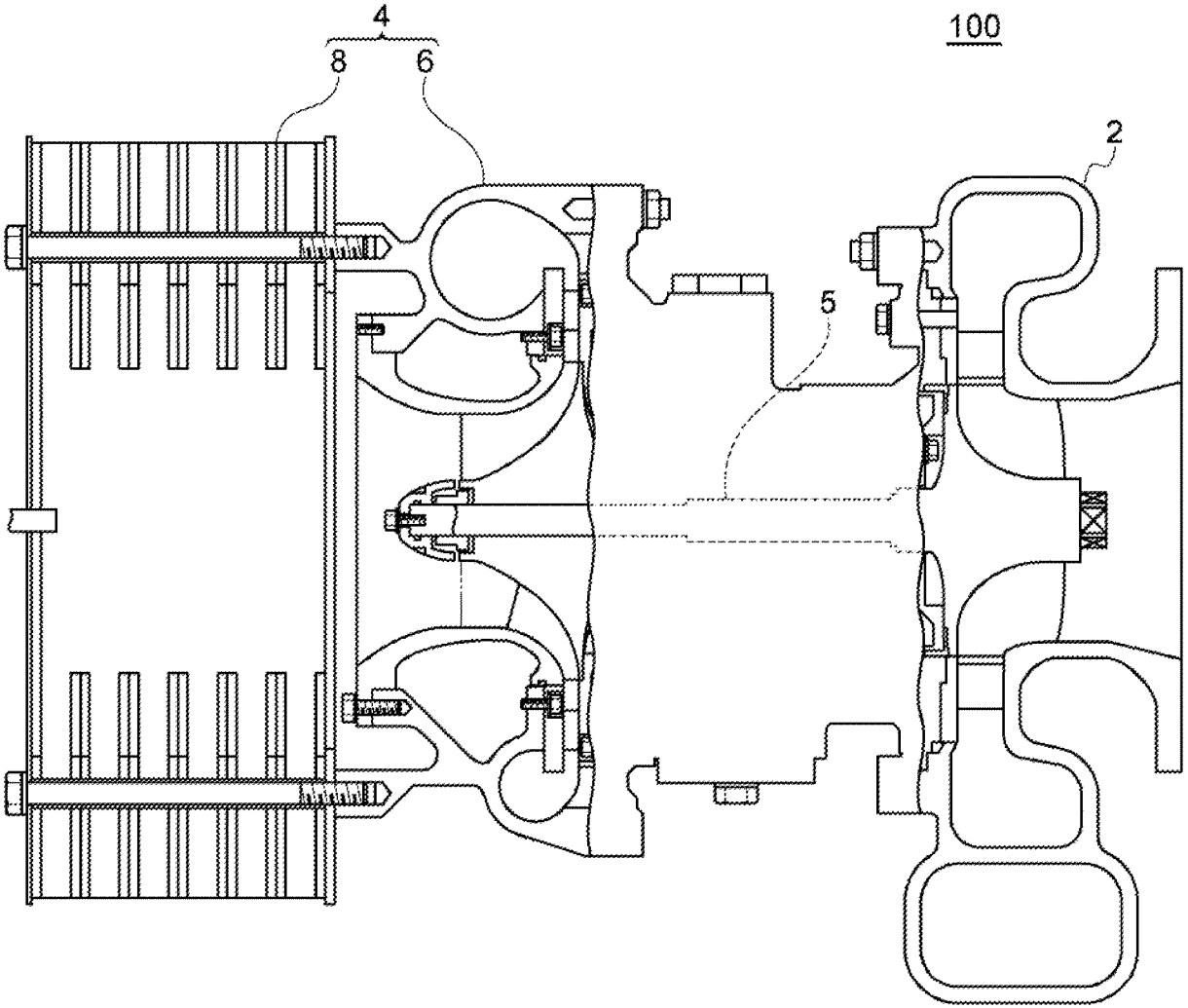
FIG. 1 is a schematic cross-sectional diagram illustrating an overall configuration of a supercharger 100 according to an embodiment.

FIG. 1 is a schematic cross-sectional diagram illustrating an overall configuration of a supercharger 100 according to an embodiment.

The supercharger 100 shown in FIG. 1 is an exhaust turbine type supercharger (turbocharger) and includes a turbine 2 and a compression device 4.

The turbine 2 is driven by exhaust gas of an internal combustion engine (for instance, a diesel engine or a gasoline engine) (not shown) used in ships or the like.

The compression device 4 includes a centrifugal compressor 6 connected to the turbine 2 via a rotational shaft 5 and a silencer 8 for reducing noise caused from the centrifugal compressor 6. The centrifugal compressor 6 is configured to be driven by the turbine 2 to compress air (fluid) to be supplied to the internal combustion engine.

Figure 2:
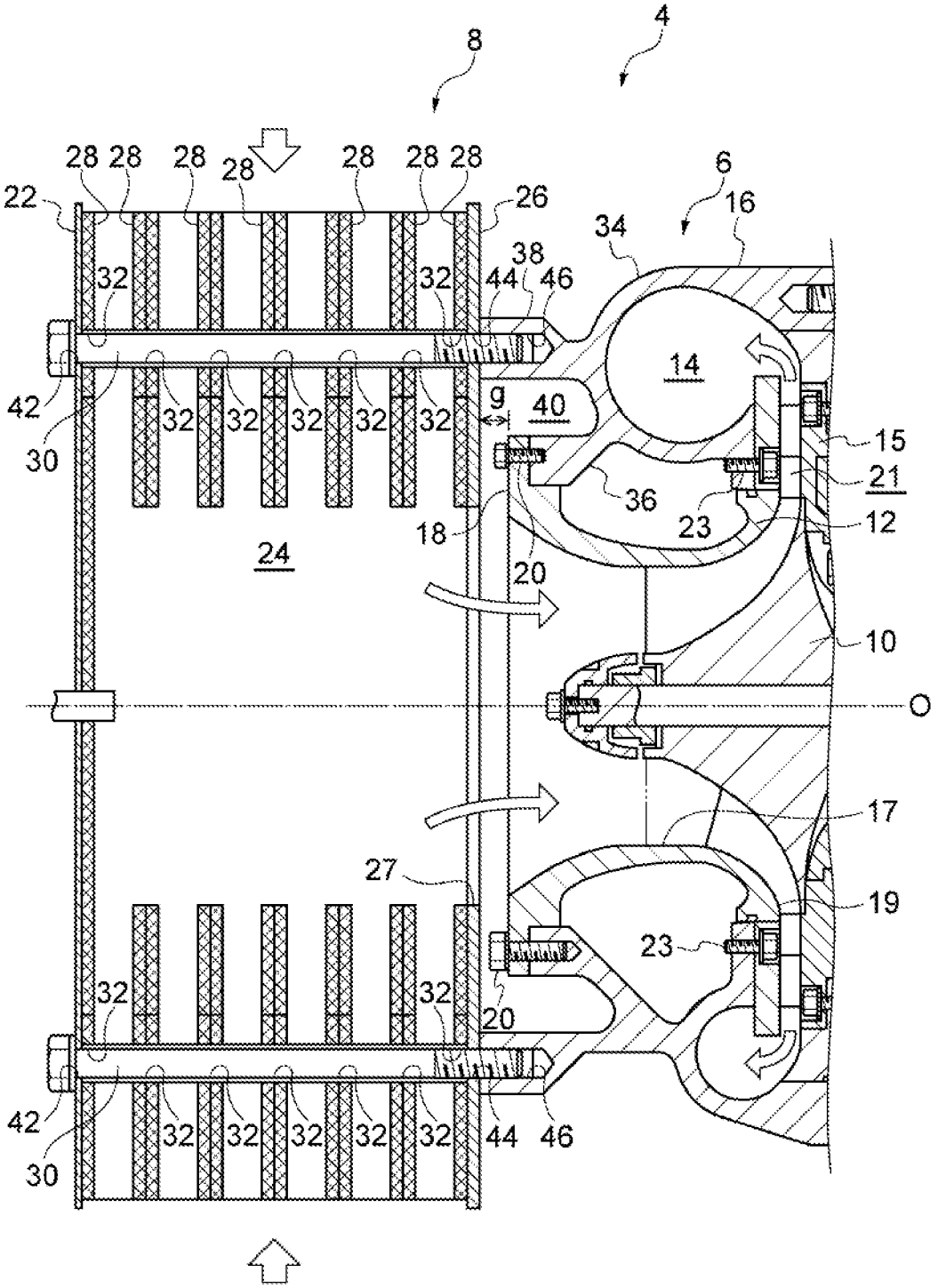
FIG. 2 is a schematic diagram illustrating an overall configuration of a compression device 4 according to an embodiment.

FIG. 2 is a schematic cross-sectional diagram illustrating an overall configuration of the compression device 4.

As shown in FIG. 2, the centrifugal compressor 6 includes an impeller 10 for compressing air, an air inlet guide 12, housing the impeller 10, for guiding the air, a scroll casing 16 forming a scroll chamber 14 for guiding the air having passed through the air inlet guide 12 to outside, and compressor assembly bolts 20 each fastening an inlet side 18 of the air inlet guide 12 to the scroll casing 16. The compressor assembly bolts 20 are provided on several locations at a certain interval in the circumferential direction of the impeller 10.

In the illustrated embodiment, the air inlet guide 12 has a cylindrical shape in which the opening diameters at the inlet side 18 and an outlet side 19 are formed to be larger than the opening diameter at a middle portion 17. Within the air inlet guide 12, the impeller 10 is housed. The scroll casing 16 is an annular member which is provided at an outer peripheral side of the air inlet guide 12 and fixed to the air inlet guide 12 as described later. Moreover, an annular diffuser member 15, which defines a diffuser passage 21 connecting an interior of the air inlet guide 12 to the scroll chamber 14, is arranged on an outer peripheral portion at the outlet side 19 of the air inlet guide 12. The diffuser member 15 is fitted to the outer peripheral portion of the air inlet guide 12 at the outlet side 19 of the air inlet guide 12, and fastened to the scroll casing 16 with bolts 23.

As shown in FIG. 2, the silencer 8 includes a disc-shaped first side wall 22 extending in a direction orthogonal to a rotational axis O of the impeller 10, and an annular second side wall 26 provided between the first side wall 22 and the centrifugal compressor 6 and surrounding the rotational axis O. Between the first side wall 22 and the second side wall 26 is formed an ambient-air introduction space 24 for guiding ambient air (air) to the air inlet guide 12. A central portion of the second side wall 26 is provided with a central opening 27.

The silencer 8 also includes at least one silencer element 28 provided in the ambient-air introduction space 24 and silencer assembly bolts penetrating through the silencer 8 in a direction along the rotational axis O of the impeller 10 and fastening the silencer 8 to the scroll casing 16. The silencer assembly bolts extend from the first side wall 22 to the scroll casing 16 in a direction along the rotational axis O of the impeller 10 and fasten the first side wall 22, the second side wall 26, and the scroll casing 16. The silencer assembly bolts 30 are provided on several locations at a certain interval in the circumferential direction of the impeller 10.

With the silencer 8, ambient air is taken into the ambient-air introduction space 24 from the outer periphery of the silencer 8 upon rotating the impeller 10 of the centrifugal compressor 6. The ambient air taken into the ambient-air introduction space 24, after passing through the silencer elements 28, turns toward the rotational axis O and passes through the central opening 27 of the annular second side wall 26, consequently entering into the air inlet guide 12.

Figure 3:
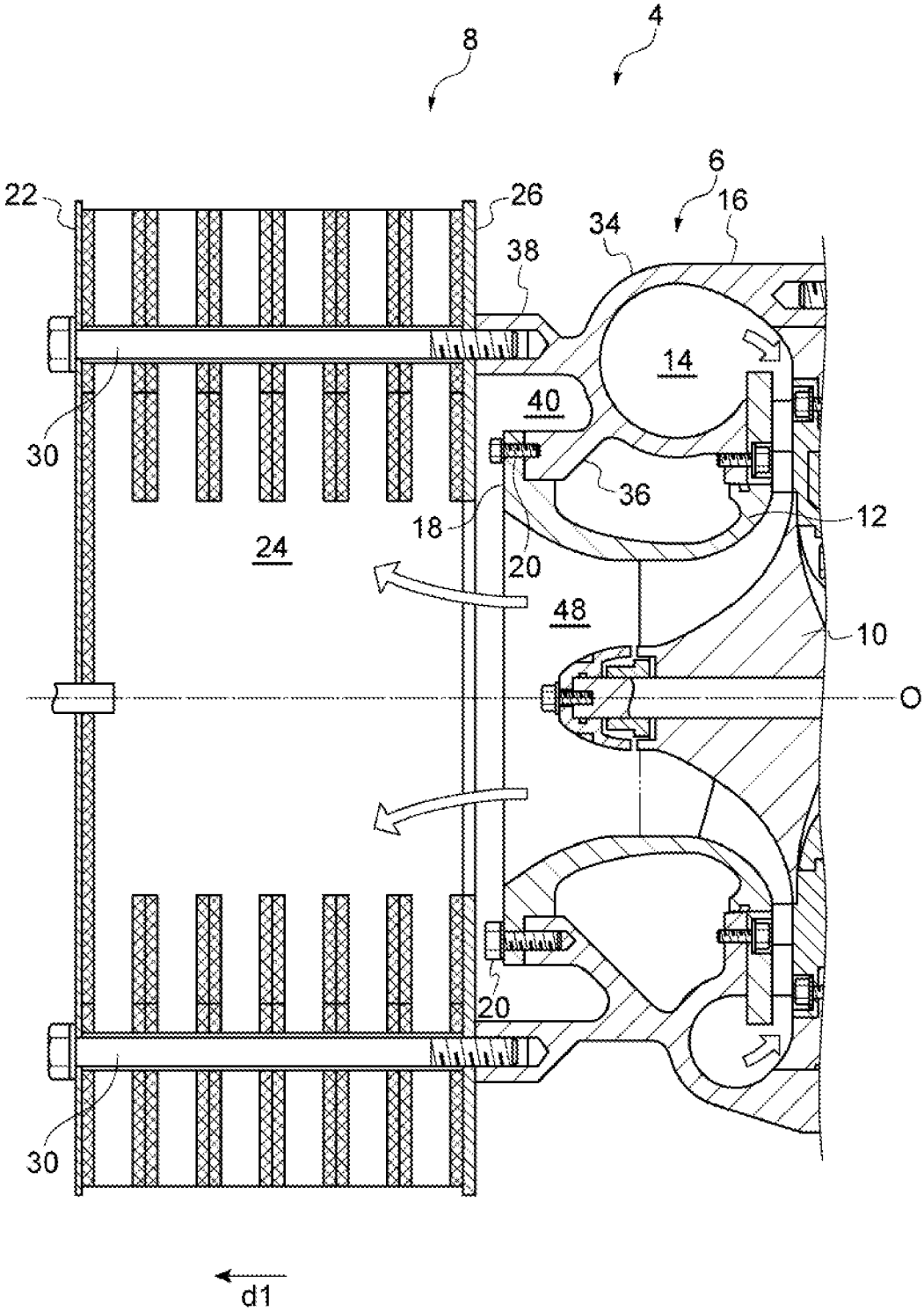
FIG. 3 is a schematic diagram illustrating an overall configuration of a compression device 4 according to an embodiment.

When the impeller 10 breaks apart in the centrifugal compressor 6 shown in FIG. 2, air is hard to be forced into the scroll chamber 14 by the impeller 10, and rather flows back from the scroll chamber 14 to the silencer 8 through the air inlet guide 12, as shown by the white arrows in FIG. 3. This backflow air applies force to the silencer 8 in a direction d1 away from the air inlet guide 12.

Figure 4:
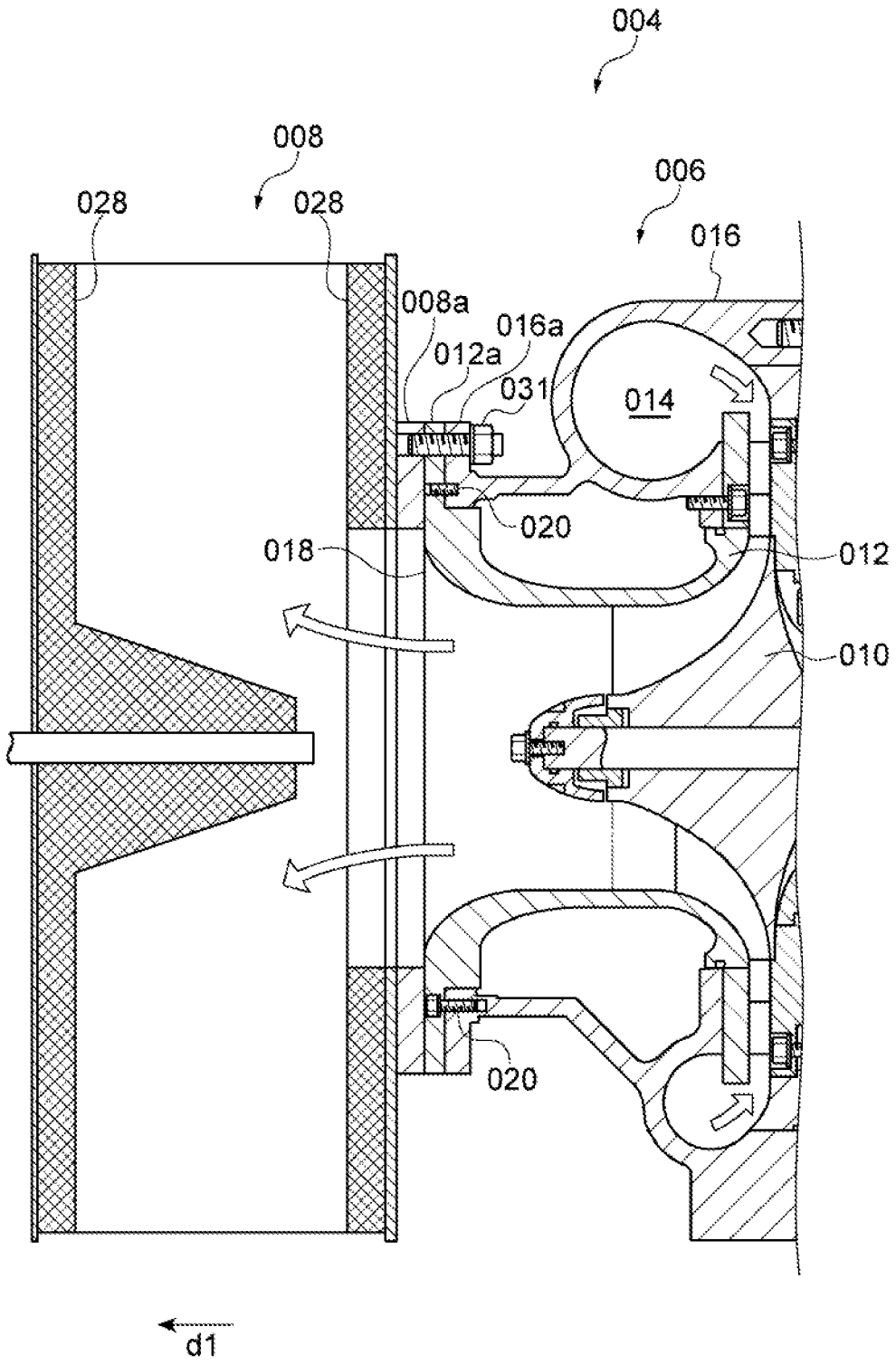
FIG. 4 PRIOR ART
FIG. 4 is a schematic cross-sectional diagram illustrating an overall configuration of a conventional compression device 004.

In this regard, with the compression device 4, each silencer assembly bolt 30, which fastens the first side wall 22 and the second side wall 26, extends from the first side wall 22, while penetrating through the silencer 8, to the scroll casing 16 in a direction along the rotational axis O of the impeller 10, and thereby also fastens the scroll casing 16. Thus, the bolt (silencer assembly bolt 30) fastening the silencer 8 to the centrifugal compressor 6 can be significantly longer than the bolt (silencer attachment bolt 031) fastening the silencer 008 to the centrifugal compressor 006 in the conventional configuration (see FIG. 4).

Consequently, the bolt (silencer assembly bolt 30) fastening the silencer 8 to the centrifugal compressor 6 in the compression device 4 can have a larger elongation amount that allows the bolt to elongate without breakage when tensile load is applied in a length direction than an elongation amount of the bolt (silencer attachment bolt 031) fastening the silencer 008 to the centrifugal compressor 006 in the conventional configuration (see FIG. 4) that allows the bolt to elongate without breakage when tensile load is applied in a length direction.

In this way, even if tensile stress caused by air backflow due to breakage of the impeller 10 is applied to the bolt (silencer assembly bolt 30) fastening the silencer 8 to the centrifugal compressor 6, it is possible to effectively reduce breakage of the bolt. Therefore, it is possible to reduce breakage of the bolt (silencer assembly bolt 30) fastening the silencer 8 to the centrifugal compressor 6 and enable the silencer 8 and the centrifugal compressor 6 to be stably connected.

Additionally, the silencer 8 is fastened to the centrifugal compressor 6 with the silencer assembly bolt 30 which is different from the compressor assembly bolt 20 fastening the inlet side 18 of the air inlet guide 12 to the scroll casing 16. Thus, even if the impeller 10 breaks apart and an impeller fragment hits the air inlet guide 12, a shock of hitting does not propagate directly from the air inlet guide 12 to the silencer assembly bolt 30, but propagates from the air inlet guide 12 to the silencer assembly bolt via the scroll casing 16. This fact also supports that breakage of the silencer assembly bolt 30 fastening the silencer 8 to the centrifugal compressor 6 can be effectively reduced, compared with the conventional configuration (see FIG. 4).

Additionally, since the silencer assembly bolt 30 extends from the first side wall 22 to the scroll casing 16 in the direction along the rotational axis O of the impeller 10 and fastens the first side wall 22, the second side wall 26, and the scroll casing 16, the overall rigidity of the compression device 4 can be improved.

In an embodiment, as shown in FIG. 2, the at least one silencer element 28 is supported, in the ambient-air introduction space 24, by the silencer assembly bolt 30.

This configuration allows the first side wall 22, the second side wall 26, and the scroll casing 16 to be fastened by means of the silencer assembly bolt 30 which supports the silencer element 28 in the ambient-air introduction space 24. Thus, the silencer 8 and the centrifugal compressor 6 can be stably connected with a simple configuration.

In an embodiment, as shown in FIG. 2, the at least one silencer element 28 includes a plurality of silencer elements 28 arranged along a radial direction around the rotational axis O. Additionally, each of the plurality of silencer elements 28 is an annular element provided around the rotational axis O, and has an insert hole 32 into which the silencer assembly bolt 30 is inserted, and the silencer element 28 is supported, in the ambient-air introduction space 24, by the silencer assembly bolt 30 inserted into the insert hole 32. In the illustrated embodiment, the silencer assembly bolt 30 is inserted into an insert hole 42 provided in the first side wall 22, the insert hole 32 of each silencer element 48, and an insert hole 44 provided in the second side wall 26 in this order, and then screwed into a bolt hole 46 formed in the scroll casing 16.

This configuration allows the first side wall 22, the second side wall 26, and the scroll casing 16 to be fastened by means of the silencer assembly bolt 30 which supports the plurality of annular silencer elements 28 arranged along the rotational axis O of the impeller in the ambient-air introduction space 24. Thus, the silencer 8 and the centrifugal compressor 6 can be stably connected with a simple configuration.

In an embodiment, as shown in FIG. 2, the scroll casing 16 includes a scroll chamber-forming portion 34 forming the scroll chamber 14, an annular first projection 36 projecting from the scroll chamber-forming portion 34 toward the silencer 8, and an annular second projection 38 projecting from the scroll chamber-forming portion 34 toward the silencer 8. The second projection 38 is disposed more outwardly than the first projection 36 in the radial direction of the impeller 10. Additionally, the compressor assembly bolt 20 fastens the inlet side 18 of the air inlet guide 12 and the first projection 36, while the silencer assembly bolt 30 fastens the first side wall 22, the second side wall 26, and the second projection 38.

With this configuration, the second projection 38 fastened to the silencer 8 is disposed more outwardly than the first projection 36 fastened to the inlet side 18 of the air inlet guide 12 in the radial direction of the impeller 10. Thus, it is possible to reduce a risk that an impeller fragment penetrates the air inlet guide 12 or the first projection 36 and reaches the second projection 38 or the vicinity thereof when the impeller 10 breaks apart. In this way, it is possible to reduce breakage of the second projection 38 and to enable the silencer 8 and the centrifugal compressor 6 to be stably connected.

In an embodiment, as shown in FIG. 2, the second projection 38 projects further than the first projection 36 toward the silencer 8 and abuts on the second side wall 26 of the silencer 8. Additionally, a gap g is provided between the inlet side 18 of the air inlet guide 12 and the second side wall 26 of the silencer 8 so that an annular space 40 formed between the first projection 36 and the second projection 38 communicates with a space 48 inside the air inlet guide 12.

When the impeller 10 breaks apart, air that flows back from the scroll chamber 14 to the silencer 8 has a higher pressure than atmospheric pressure. In this regard, the above configuration allows, when air flows back from the scroll chamber 14 to the silencer 8, the annular space 40 between the first projection 36 and the second projection 38 to function as a buffer space for controlling an increase of pressure in the ambient-air introduction space 24 inside the silencer 8.

Thus, it is possible to reduce force which is caused by the backflow air and applied to the silencer 8 in the direction d1 (see FIG. 3) away from the air inlet guide 12. This makes it possible to reduce tensile stress applied to the silencer assembly bolt 30 and reduce breakage of the silencer assembly bolt 30. Consequently, the silencer 8 and the centrifugal compressor 6 can be stably connected.

Embodiments of the present invention were described in detail above, but the present invention is not limited thereto, and various amendments and modifications may be implemented.

For instance, application of the present invention is not limited to the above described exhaust turbine type supercharger (turbocharger), and may be a mechanical supercharger for driving a compressor with power extracted from an output shaft of an internal combustion engine via a belt or the like.

REFERENCE SIGNS LIST

2 Turbine
4 Compression device
6 Centrifugal compressor
5 Rotational shaft
8 Silencer
10 Impeller
12 Air inlet guide
14 Scroll chamber
16 Scroll casing
18 Inlet side
20 Compressor assembly bolt
22 First side wall
24 Ambient-air introduction space
25 Bolt
26 Second side wall
27 Central opening
28 Silencer element
30 Silencer assembly bolt
32 Insert hole
34 Scroll chamber-forming portion
36 First projection
38 Second projection
40 Space
42 Insert hole
44 Insert hole
46 Bolt hole
48 Space
100 Supercharger
O Rotational axis
d1 Arrow
d2, d4 Direction
004 Compression device
006 Centrifugal compressor
008 Silencer
008*a* Flange
010 Impeller
012 Inlet guide
012*a* Flange
014 Scroll chamber
016 Scroll casing
016*a* Flange
020 Compressor assembly bolt
028 Silencer element
031 Silencer attachment bolt

The invention claimed is:

1. A compression device comprising a centrifugal compressor and a silencer, the centrifugal compressor comprising:

an impeller for compressing a fluid;

an inlet guide, housing the impeller, for guiding the fluid; and a scroll casing forming a scroll chamber for guiding the fluid which has passed through the inlet guide to outside, the scroll casing consisting of a single member;

wherein the silencer comprises a silencer assembly bolt penetrating through the silencer in a direction along a rotational axis of the impeller and fastening the silencer to the scroll casing, wherein the silencer comprises: a first side wall extending in a direction intersecting with the rotational axis of the impeller; and an annular second side wall provided between the first side wall and the centrifugal compressor and surrounding the rotational axis, wherein an ambient-air introduction space for guiding an ambient air to the inlet guide is formed between the first side wall and the second side wall, wherein the silencer assembly bolt extends from the first side wall to the scroll casing in a direction along the rotational axis of the impeller and fastens the first side wall, the second side wall, and the scroll casing, wherein the silencer further comprises at least one silencer element provided in the ambient-air introduction space, wherein the silencer element is supported, in the ambient-air introduction space, by the silencer assembly bolt, wherein the scroll casing comprises a scroll chamber-forming portion forming the scroll chamber, and an annular outer projection projecting from the scroll chamber-forming portion toward the silencer, and wherein the silencer assembly bolt fastens the silencer and the outer projection in a state where the second side wall abuts the outer projection.

2. The compression device according to claim 1, wherein the at least one silencer element comprises a plurality of silencer elements arranged along the rotational axis, and wherein each of the plurality of silencer elements is an annular element provided around the rotational axis and has an insert hole into which the silencer assembly bolt is inserted, and the silencer element is supported, in the ambient-air introduction space, by the silencer assembly bolt inserted into the insert hole.

3. The compression device according to claim 1, wherein the centrifugal compressor further comprises a compressor assembly bolt fastening an inlet side of the inlet guide to the scroll casing, wherein the scroll casing comprises an annular inner projection projecting from the scroll chamber-forming portion toward the silencer, the inner projection being disposed more inwardly than the outer projection in a radial direction of the impeller, and wherein the compressor assembly bolt fastens the inlet side of the inlet guide and the inner projection.

4. The compression device according to claim 3, wherein the outer projection projects further than the inner projection toward the silencer, and wherein a gap is provided between the inlet guide and the silencer so that a space formed between the inner projection and the outer projection communicates with a space inside the inlet guide.

5. The compression device according to claim 1, wherein the silencer assembly bolt is screwed into a bolt hole formed in the scroll casing.

6. The compression device according to claim 1 which is configured so that, even when the impeller breaks apart and an impeller fragment hits the inlet guide, a shock of hitting does not propagate directly from the inlet guide to the silencer assembly bolt, but propagates from the inlet guide to the silencer assembly bolt via the scroll casing.

7. The compression device according to claim 1, wherein the silencer is not in contact with the inlet guide.

8. The compression device according to claim 1, wherein the centrifugal compressor further comprises:

a diffuser member fitted to an outer peripheral portion of the inlet guide at an outlet side of the inlet guide and forming a diffuser passage connecting an interior of the inlet guide to the scroll chamber; and a bolt fastening the diffuser member and the scroll casing.

9. A supercharger comprising the compression device according to claim 1 and a turbine configured to rotate with the centrifugal compressor of the compression device.

* * * * *